US007189277B2

(12) United States Patent
Morris

(10) Patent No.: US 7,189,277 B2
(45) **Date of Patent: *Mar. 13, 2007**

(54) STABILIZED IRON-BASED POWDERED METAL MOLDING COMPOSITIONS

(76) Inventor: Robert Craig Morris, 208A Emmans Rd., Flanders, NJ (US) 07836

( * ) Notice: Subject to any disclaimer, the term of this patent is extended or adjusted under 35 U.S.C. 154(b) by 18 days.

This patent is subject to a terminal disclaimer.

(21) Appl. No.: 10/922,463

(22) Filed: Aug. 20, 2004

(65) Prior Publication Data

US 2006/0037433 A1 Feb. 23, 2006

(51) Int. Cl.
*C22C 33/02* (2006.01)

(52) U.S. Cl. ..... 75/255

(58) Field of Classification Search ..... 75/255
See application file for complete search history.

(56) References Cited

U.S. PATENT DOCUMENTS 4,167,582 A * 9/1979 Takahashi et al. ..... 428/328
5,256,326 A * 10/1993 Kawato et al. ..... 252/62.54
5,397,520 A * 3/1995 Rohrbach et al. ..... 264/122
5,746,957 A * 5/1998 Fanelli et al. ..... 264/109
6,261,336 B1 * 7/2001 Behi et al. ..... 75/246
6,291,560 B1 * 9/2001 Behi et al. ..... 524/27
6,309,573 B1 * 10/2001 Schoonover et al. ..... 264/109
6,635,099 B2 * 10/2003 LaSalle et al. ..... 75/247
6,669,880 B2 * 12/2003 Behi et al. ..... 264/115
6,689,184 B1 * 2/2004 Morris ..... 75/246

* cited by examiner

*Primary Examiner*—Daniel Jenkins
(74) *Attorney, Agent, or Firm*—Sheldon Kavesh

(57) ABSTRACT

Molding compositions and forming processes for normally rust-prone iron-based powders, and articles produced therefrom. Metal alloy systems that can be successfully formed using the processes of the invention, include elemental iron and iron alloys including low and medium alloy steels, tool steels and a number of specialty iron-base alloys.

8 Claims, 5 Drawing Sheets

STABILIZED IRON-BASED POWDERED METAL MOLDING COMPOSITIONS

BACKGROUND OF THE INVENTION

1. Field of the Invention

This invention relates to molding compositions and forming processes for normally rust-prone iron-based metal alloy powders, and articles produced therefrom. Metal alloy systems that can be successfully formed using the processes of the invention, include elemental iron and iron alloys, including low and medium alloy steels, tool steels, and a number of specialty iron-base alloys.

2. Description of the Related Art

A widely used process for forming metal powders into complex three dimensional shapes is Metal Injection Molding (MIM). The steps of fabrication of metal or ceramic-metallic (CERMET) parts are the following:

i. Metal and/or ceramic powders are blended with a thermoplastic binder material to create an injection molding feedstock with thermoplastic properties.

ii. The thermoplastic feedstock is injection molded in a fluid state using methods and tools typical of conventional plastic injection molding, and removed from the mold in a solid state.

iii. The "green" state as-molded parts are subjected to thermal and/or chemical processes to remove the binder phase.

iv. The resulting "brown" state metal or CERMET parts are sintered at higher temperatures to effect consolidation and densification of the molded object.

Several methods, processes, and binder systems have previously been described for fabrication of rust prone iron-based metal alloys and CERMET materials containing them. Each of these processes has one or more disadvantages that prevent important applications.

For example, commonly utilized polymer or wax binder MIM processes, such as the methods described by Achikita et al. in U.S. Pat. No. 5,250,254, while they work well with rusting iron alloys, are limited to small parts, weighing no more than a few hundred grams, and with maximum section thickness of less than 10 millimeters. These limitations are imposed by the difficulties associated with binder removal prior to sintering. The manufacture of larger parts is prevented or rendered uneconomical by dimensional instability, cracking, or simply the long times needed for binder removal from larger and thicker sections. In addition, great care must by taken when using wax or resin binders to avoid an undesirable out-of-specification increase in the carbon content of the alloy as a result of incomplete removal of the hydrocarbon binder phase.

Fanelli et al., in U.S. Pat. No. 4,734,237, disclose agaroid-based aqueous binders for molding of metal and ceramic powders. The development of aqueous-binder molding compositions, including those disclosed by Fanelli et al., has largely removed the part size restrictions imposed by wax and polymer binders, since the binder phase in these largely consists of water which is easily removed by evaporation under ambient conditions. In the special case of agar-based binders, the carbon content problem associated with wax and polymer binders is also reduced since the agar component of the binder is largely gasified at relatively low temperatures during the early stages of the sintering cycle. Further reduction in carbon content is easily achieved by employing an oxidizing atmosphere in the early stages of the sintering heat treatment as taught by Zedalis in U.S. Pat. No. 5,985,208. Carbon content can also be reduced by heat treatment in hydrogen as taught by Wu et al., "Effects of residual carbon content on sintering shrinkage, microstructure and mechanical properties of injection molded 17-4 PH stainless steel,: Journal of Materials Science, 37 (2002) pp. 3573–3583.

Zedalis et al., in U.S. Pat. No. 6,268,412, incorporated herein by reference to the extent not incompatible herewith, disclose molding compositions and processing steps for injection molding of non-rust-prone stainless steel articles using water-base agaroid binder systems. Stainless steels, a family of iron-based alloys containing between 10.5 and 28 atomic % chromium, are compatible with water-based binder systems, since the high chromium content confers great resistance to oxidation in the presence of water.

When rust-prone iron-base alloy powders are substituted for the stainless steel powders in the process taught by Zedalis, the resulting molding feedstock is chemically unstable and must be molded and dried within hours, or the water will react with the iron-base alloy powder to form rust, thereby substantially altering and degrading the Theological properties, as-molded strength, sintering, and shrinkage behavior of the feedstock.

It is commonly observed that ferrous alloys progressively oxidize or rust in the presence of air and moisture. The essential chemistry of rust formation, as described in *The Metals Handbook*, Volume 1, $8^{th}$ Edition, published by the American Society for Metals (1961) p257, follows. In the first step of the reaction, iron reacts with water to form ferrous and hydroxyl ions and hydrogen:

$$Fe+2H_2O=Fe^{++}+2OH^-+H_2 \quad (1)$$

In a second step, oxygen, if present, reacts with the ferrous ions to produce ferric ions which precipitate out of solution as insoluble ferric hydroxide FeO(OH), otherwise known as rust. Since the rust deposit does not form a protective layer, reaction 1 is free to proceed until the metallic iron is consumed or equilibrium is reached.

The equilibrium constant for reaction 1 is:

$$K=[Fe^{++}][OH^-]^2P_{H2} \quad (2)$$

where the square brackets indicate the concentration of the species and $P_{H2}$ is the partial pressure of hydrogen.

Equation 2 suggests that the equilibrium concentration of $Fe^{++}$ can be suppressed by increasing the hydroxyl ion concentration, equivalent to increasing the pH, and/or increasing the hydrogen partial pressure.

Rusting can be further inhibited by passivation of the exposed ferrous alloy surface. Typically, passivation involves a thin but impervious layer of iron oxide formed, in-situ, by reaction of the iron with oxidizing ions. Pourbaix, in *Atlas of Electrochemical Equilibria in Aqueous Solutions*, Pergamon Press, New York (1966) p. 312 states that passivation of iron is difficult at a pH below 8, relatively easy at a pH above 8 and very easy between pH 10 and 12. Above pH 13, according to Pourbaix, iron will corrode by hyperferrate ion formation. Passivation of ferrous alloy surfaces is typically effected by the addition of oxidizers to aqueous environments. For example, nitrite and nitrate salts have been used in this manner as rust-inhibiting additives in cooling water and other process water applications. pH buffers, salt solutions formed by reaction of weak acids with strong bases, are frequently employed with nitrites and nitrates to maintain pH in the proper range. *The Metals Handbook*, Vol. 1, $8^{th}$ Ed., American Society for Metals, P. 279, 1961 states that sodium nitrate-borate combinations have been used to inhibit corrosion in diesel engine cooling systems and in low pressure, hot water recirculating systems. In this case, sodium borate, a salt formed by reaction of the weak acid $H_3BO_3$ with the strong base NaOH, supposedly functions as a pH buffer. In a similar fashion, calcium nitrite is frequently added to concrete formulations to inhibit rusting of embedded steel reinforcing bars. In this case, the desired alkaline environment is synergistically provided by the calcium oxide component of the Portland cement concrete.

Interestingly, various metal borate additives to enhance the gel strength and viscosity of polysacharide-based aqueous binders for molding have been disclosed by Sekido et al. in U.S. Pat. No. 5,258,155, and Fanelli et al. in U.S. Pat. No. 5,746,957. Anions of boric acid, acting in concert with metal cations are thought to induce crosslinking of the agar polysaccharide molecules, thereby substantially increasing the viscosity of the agar-water sol and the strength of the gel. Fanelli et al. teaches that calcium borate, magnesium borate, zinc borate, ammonium borate, tetraethyl ammonium borate, tetramethyl ammonium borate, and boric acid are preferred gel strengthening additives for agaroid binder powder injection molding of ceramic and/or metal powders.

Sekido et al., broadly teach the use of sodium borate for gel strengthening but, Sekido does not define sodium borate in useful chemical terms. That is, neither the preferred concentration range nor the preferred stoichiometry range (i.e., the preferred atomic fractions of sodium and boron) are specified.

For the purposes of the present invention, it is important to clearly distinguish between the different borate salts of sodium and potassium. According to the CRC Handbook of Chemistry and Physics $56^{th}$ edition, CRC Press, Cleveland Ohio (1974), two crystalline sodium borate salts are known, sodium tetraborate ($Na_2B_4O_7$) and sodium metaborate ($NaBO_2$). Moreover, both of these may occur as anhydrous or hydrated salts. The most familiar sodium borate salt is the mineral borax, or sodium tetraborate decahydrate ($Na_2B_4O_7.10H_2O$). In aqueous sodium borate solutions, of course, one is not limited to these fixed stoichiometry compounds and a continuous range of boron to sodium ratios can be obtained between the endpoints NaOH and $H_3BO_3$. Similarly, potassium tetraborate, potassium tetraborate tetrahydrate, potassium metaborate and other fixed stoichiometry crystalline potassium borate compounds are known, but any boron to potassium ratio can be obtained in solution. The various sodium and potassium borate salts are formed by reaction of the weak acid $H_3BO_3$ with the strong bases NaOH and KOH. For example:

$$H_3BO_3+NaOH=NaBO_2+2H_2O \quad (3)$$

For clarity in describing various borate salts herein, the molar ratio of $H_3BO_3$ to NaOH will be used to specify the stoichiometry of sodium borate salt solutions, and the molar ratio of $H_3BO_3$ to KOH will be used to specify the stoichiometry of potassium borate salt solutions. These ratios are the same as the atomic ratios of boron to sodium and boron to potassium. Thus, $Na_2B_4O_7$ has a B:Na ratio of 2:1 while $NaBO_2$ has a B:Na ratio of 1:1. We will also at times use the mole fraction of $H_3BO_3$ used to make the salt solution, defined as (moles $H_3BO_3$)/(moles $H_3BO_3$+moles (Na,K) OH). Thus, a solution of $NaBO_2$ has a mole fraction of $H_3BO_3$ of 0.5 or 50%, and a solution of $Na_2B_4O_7$ has a mole fraction of $H_3BO_3$ of 0.66 or 66%. These conventions are convenient for the synthesis of various sodium and potassium borate salt solutions from boric acid ($H_3BO_3$), which is available as a crystalline solid, and the respective sodium and potassium hydroxides, which are readily available as solutions of specified molar concentration.

Thus, the concentration and stoichiometry of a solution of any sodium or potassium borate salt can be fully described by specifying the equivalent molar concentrations of $H_3BO_3$ and NaOH or KOH in the solution.

For example, Sekido, in his Example 1, used a combination of agar and an aqueous solution of sodium borate as a binder for 316 stainless steel powder. The concentration of sodium borate in the water was about 0.3 wt. %. Presumably the sodium borate used was common borax (sodium tetraborate decahydrate). The molar concentration of $Na_2B_4O_7.10H_2O$ was therefore 0.0079 moles/liter, the equivalent molar concentration of $H_3BO_3$ was four times this or 0.0316, and the equivalent molar concentration of NaOH was twice that of $Na_2B_4O_7.10H_2O$ or 0.0158.

Behi et al. in U.S. Pat. No. 6,261,336, specifically addressed the problem of rust formation in aqueous agar binder injection molding feedstocks containing rust-prone ferrous alloy powders, and taught that these materials can be stabilized against rust formation by the addition of alkaline sodium silicate to the aqueous binder. It was shown by Behi that carbonyl iron powder feedstocks containing appropriate amounts of sodium silicate are somewhat stable against rust formation and attendant hydrogen evolution, and that the stability is further enhanced by the addition of potassium borate. The sodium silicate is thought to function by reacting with the iron surface to form a barrier layer of iron silicate and the potassium borate in this application apparently serves as a pH buffer similar to the use of the sodium borate/nitrite combination discussed above. Behi cites potassium tetraborate and potassium tetraborate tetrahydrate as preferred potassium borate compounds and gives a preferred borate concentration range of from about 0.01 to about 0.2 weight % of the composition (which would correspond to about 0.125–2.5% weight % relative to the aqueous solvent at a typical moisture content of 8 wt. %). While Behi's sodium silicate/potassium borate stabilized feedstocks certainly represent an improvement over unstabilized iron-based aqueous binder feedstocks, experience with the sodium silicate stabilized feedstocks has revealed that the long term chemical stability is marginal, and that the sodium silicate addition renders the feedstock pellets somewhat tacky and difficult to feed through the hopper of an injection molding machine. Moreover, residual $SiO_2$ and/or iron silicate inclusions, resulting from decomposition of higher loadings of the sodium silicate during sintering, may be undesirable for applications requiring maximum ductility and fatigue resistance in the final sintered steel part.

More recently, Morris, in U.S. Pat. No. 6,689,184, has disclosed stabilization of rusting iron aqueous molding feedstocks using a combination of borate and nitrate/nitrite salts. One disadvantage of this system is that the nitrate and nitrite salts serve as nutrients for a range of micro-organisms. Another disadvantage is that the nitrate and nitrite salts may tend to oxidize minor alloy components such as silicon and chromium during the elevated temperature sintering process.

Thus, a need remains for new materials and methods enabling molding of rust prone iron-based alloys that avoid the size limitations of the prior art wax and polymer based binders, and the processing and ductility limitations of sodium silicate and nitrite/nitrate stabilized aqueous binders.

SUMMARY OF THE INVENTION

Surprisingly, it has been found that the addition of the sodium and/or potassium salts of boric acid, in specific ranges of concentration and stoichiometry, without oxidizing agents or silicates, is sufficient to stabilize some, normally rust prone, iron-base alloy powders in contact with aqueous agar gel binders for periods exceeding 2 months.

In one embodiment, the invention is a corrosion resistant molding composition comprising:

a) at least one metal powder selected from the group consisting of the rusting alloys of iron;

b) a gel forming polysaccharide binder; and c) a solution comprising:

(i) at least one borate selected from the group consisting of boric acid ($H_3BO_3$), and a borate salt of sodium or potassium, said borate being present at an equivalent $H_3BO_3$ molar concentration in the range of from 0.035 to 0.3 moles/liter;

(ii) at least one alkali metal hydroxide selected from the group consisting of sodium hydroxide (NaOH), and potassium hydroxide (KOH), wherein the equivalent $H_3BO_3$ to alkali metal hydroxide molar ratio in the solution is in the range of from 0.5 to 2.0;

(iii) a solvent for said gel forming binder, said borate salt and said alkali metal hydroxide, wherein the solvent concentration in said molding composition is from 5 to 20 wt. %.

In another embodiment, the invention is a process comprising the steps of: injecting into a mold an aforedescribed molding composition, the molding composition being at a temperature above the gel point of the gel-forming material in the molding composition; cooling the molding composition in the mold to a temperature below the gel point of the gel-forming material to produce a self supporting molded article; removing the molded article from the mold; substantially removing solvent the molded article; and sintering the molded article in a protective atmosphere and under such conditions of time and temperature as are required to produce a final density greater than about 90% of the theoretical density.

In another embodiment, the invention is a process comprising the steps of: feeding an aforedescribed molding composition into an extruder; extruding the molding composition at a temperature above the gel point of the gel forming material in the molding composition through a shape forming die to form an extrudate; cooling at least the surface of the extrudate to a temperature below the gel point of the gel-forming material to produce a shaped article with at least a self supporting skin; substantially removing said solvent from said shaped article; and sintering said shaped article in a protective atmosphere and under such conditions of time and temperature as are required to produce a final density greater than about 90% of the theoretical density.

In yet another embodiment, the invention is a shaped article formed by molding or extruding, and then sintering, an aforedescribed molding composition.

DETAILED DESCRIPTION OF THE INVENTION

Figure 1:
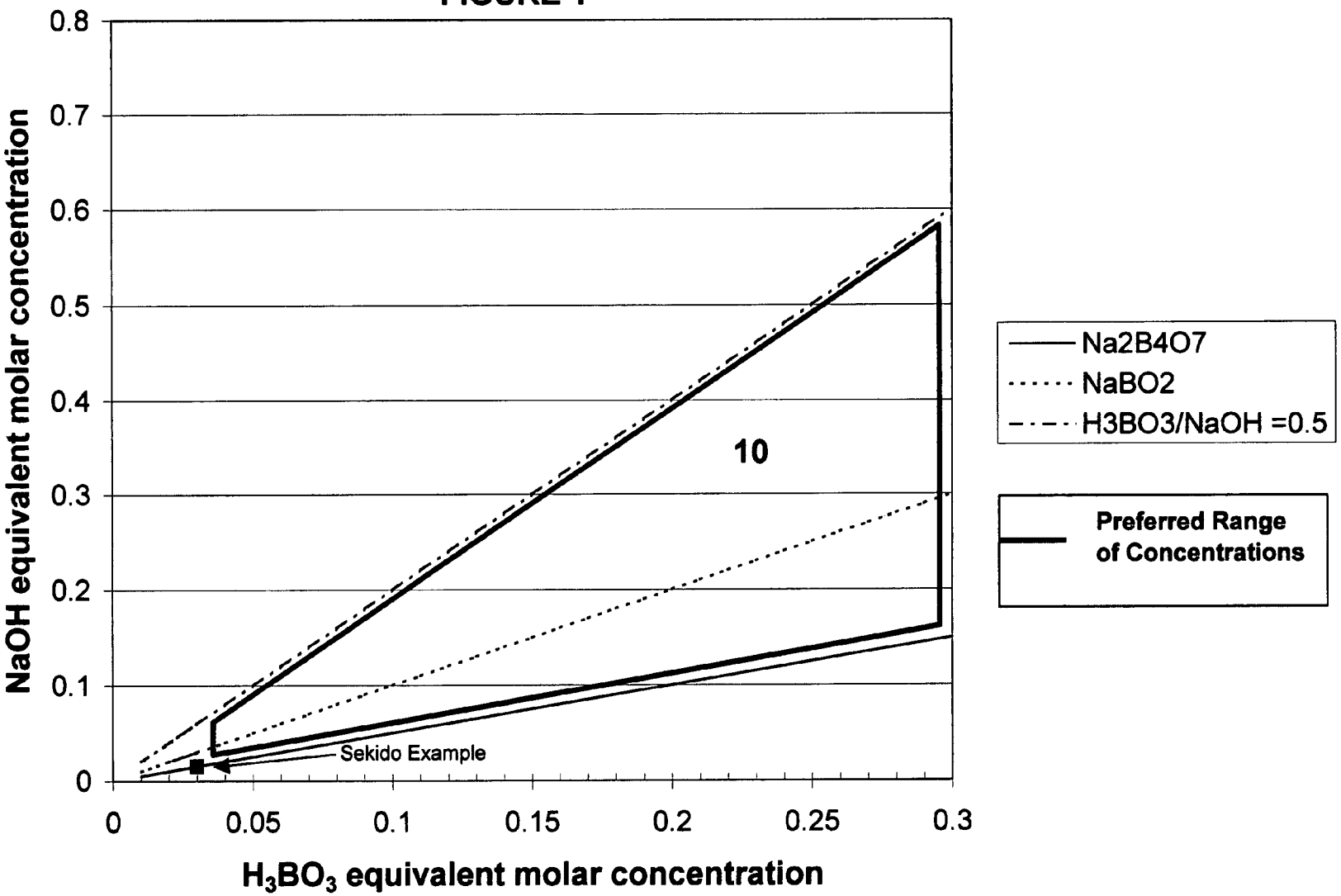
FIG. 1 shows the preferred ranges of equivalent molar concentrations of $H_3BO_3$ and NaOH with lines representing solutions of $Na_2B_4O_7$ and $NaBO_2$ compounds and a point representing Sekido's composition.

Iron-base articles are formed according to this invention from normally rust-prone metal alloy powders. In one embodiment, the invention is a corrosion resistant molding composition comprising:

1. at least one metal powder selected from the group consisting of the rusting alloys of iron;
2. a gel forming polysaccharide binder; and
3. a solution comprising:

(i) at least one borate selected from the group consisting of boric acid ($H_3BO_3$), and a borate salt of sodium or potassium, said borate being present at an equivalent $H_3BO_3$ molar concentration in the range of from 0.035 to 0.3 moles/liter;

(ii) at least one alkali metal hydroxide selected from the group consisting of sodium hydroxide (NaOH), and potassium hydroxide (KOH), wherein the equivalent $H_3BO_3$ to alkali metal hydroxide molar ratio in the solution is in the range of from 0.5 to 2.0;

It will be understood that a rusting alloy of iron is an alloy which progressively reacts with environmental moisture and oxygen to form one of several iron oxides commonly known as rust.

The rusting iron alloy metal powder may also be admixed with a minority portion (less than 50 vol. %) of a ceramic powder.

Preferably, the metal powder molding composition additionally contains a biocidal additive to prevent bacterial and fungal colonization and may also contain a ceramic powder.

The powder particles comprising the metal powder molding composition are preferably of a spheroidal shape having a weight average particle size of about 1 to about 50 microns (micrometers). More preferably, the weight average particle size is about 2 to about 20 microns and most preferably about 5 to about 15 microns. The metal powder particles are also preferably substantially dense and free of trapped gas pockets and voids. The iron-base alloy powder is preferably made by the well-known processes of gas or water atomization or carbonyl decomposition, but other methods of powder manufacture may be used if the preferred ranges of particle size, shape and density are achieved at an acceptable cost.

Some representative standard iron-base alloys, which are normally susceptible to rusting but which, in powder form, can be conveniently compounded and molded using the methods of the invention, are listed in Tables I to III. These Tables are abstracted from *The Metals Handbook*, Volume 1, 8$^{th}$ Edition, published by the American Society for Metals, (1961). It will be understood that many other standard and specialized iron-base alloys, in addition to those listed in Tables I to III, can also benefit from application of the invention.

TABLE I

Representative Carbon Alloy Steels

| SAE | Chemical composition limits for major alloying elements (atomic %) | | | | | |
|---|---|---|---|---|---|---|
| No. | C | Mn | Si | Ni | Cr | Mo |
| 1010 | 0.08–0.13 | 0.30–0.60 | 0.15–0.35 | — | — | — |
| 1330 | 0.28–0.33 | 1.60–1.90 | 0.15–0.35 | — | — | — |
| 4023 | 0.20–0.25 | 0.70–0.90 | 0.15–0.35 | — | — | — |
| 4024 | 0.20–0.25 | 0.70–0.90 | 0.15–0.35 | — | — | 0.20–0.30 |
| 4130 | 0.28–0.33 | 0.40–0.60 | 0.15–0.35 | — | 0.80–1.10 | 0.15–0.25 |
| 4320 | 0.17–0.22 | 0.45–0.65 | 0.15–0.35 | 1.65–2.00 | 0.40–0.60 | 0.20–0.30 |
| 4817 | 0.15–0.20 | 0.40–0.60 | 0.15–0.35 | 3.25–3.75 | — | 0.20–0.30 |
| 4820 | 0.18–0.23 | 0.50–0.70 | 0.15–0.35 | 3.25–3.75 | — | 0.20–0.30 |
| 9310 | 0.08–0.13 | 0.45–0.65 | 0.15–0.35 | 3.00–3.50 | 1.00–1.40 | 0.08–0.15 |

TABLE II

Representative Tool Steels.

| AISI | Chemical composition limits for major alloying elements (atomic %) | | | | | | | | |
|---|---|---|---|---|---|---|---|---|---|
| No. | C | Mn | Si | Cr | Ni | Mo | W | V | Co |
| Molybdenum high-speed steels | | | | | | | | | |
| M1 | 0.78- | 0.15- | 0.20- | 3.50- | 0.3 | 8.20- | 1.40- | 1.00- | — |
| M30 | 0.75- | 0.15- | 0.20- | 3.50- | 0.3 | 7.75- | 1.30- | 1.00- | 4.50- |
| Tungsten high speed steels | | | | | | | | | |
| T1 | 0.65- | 0.10- | 0.20- | 3.75- | 0.3 | — | 17.25 | 0.90- | — |
| T15 | 1.50- | 0.15- | 0.15- | 3.75- | 0.3 | 1.00 | 11.75 | 4.50- | 4.75- |
| Intermediate high-speed steels | | | | | | | | | |
| M50 | 0.78- | 0.15- | 0.20- | 3.75- | 0.3 | 3.90- | — | 0.80- | — |
| Chromium hot-work steels | | | | | | | | | |
| H10 | 0.35- | 0.25- | 0.80- | 3.00- | 0.3 | 2.00- | — | 0.25- | — |
| H19 | 0.32- | 0.20- | 0.20- | 4.00- | 0.3 | 0.30- | 3.75- | 1.75- | 4.00- |
| Tungsten hot-work steels | | | | | | | | | |
| H21 | 0.26- | 0.15- | 0.15- | 3.00- | 0.30 | — | 8.50- | 0.30- | — |
| H26 | 0.45- | 0.15- | 0.15- | 3.75- | 0.3 | — | 17.25 | 0.75- | — |
| Molybdenum hot-work steels | | | | | | | | | |
| H42 | 0.55- | 0.15- | — | 3.75- | 0.3 | — | 8.50- | 0.30- | — |
| Air-hardening, medium-alloy cold-work steels | | | | | | | | | |
| A2 | 0.95- | 1.00 | 0.50 | 4.75- | 0.3 | 0.90- | — | 0.15- | — |
| A10 | 1.25- | 1.60- | 1.00- | — | 1.55- | 1.25- | — | — | — |
| High-carbon, high-chromium, cold-work steels | | | | | | | | | |
| D2 | 1.40- | 0.60 | 0.60 | 11.00 | 0.3 | 0.70- | — | 1.10 | — |
| D5 | 1.40- | 0.60 | 0.60 | 11.00 | 0.3 | 0.3 | — | 1.00 | 2.50- |
| Low carbon mold steels | | | | | | | | | |
| P4 | 0.10 | 0.20- | 0.40 | 2.00- | 0.35 | — | — | — | — |
| P6 | 0.05- | 0.35- | 0.10- | 1.25- | 3.25- | — | — | — | — |

Other standard alloys within the scope of the invention include Powder Metallurgy (P/M) and Metal Injection Molding (MIM) alloys listed in *MPIF Standard* 35*: Materials Standards For PAW Structural Parts*, published by Metal Powder Industries Federation, (1997) and in *Materials Standards For Metal Injection Molded Parts*, published by Metal Powder Industries Federation, (1993). Such alloy compositions are given in Table III below.

TABLE III

Representative P/M and MIM Alloys

| Material | Chemical composition limits for major alloying elements (atomic %) | | | | |
|---|---|---|---|---|---|
| designation | Fe | Ni | C | Mo | Cu |
| F-0000 | 97.7–100 | — | 0.0–0.3 | — | — |
| FC-0200 | 93.8–98.5 | — | 0.0–0.3 | | 0.3–0.6 |
| FN-0200 | 92.2–99.0 | 1.0–3.0 | 0–0.3 | — | 0–2.5 |
| FL-4605 | 94.50–97.50 | 1.70–2.00 | 0.40–0.70 | 0.40–0.80 | — |
| FLN-4205 | 93.95–97.75 | 1.35–2.50 | 0.4–0.7 | 0.50–0.85 | — |
| FLN2-4405 | 93.30–97.90 | 1.00–3.00 | 0.4–0.7 | 0.7–1.0 | — |
| FLN4-4405 | 91.30–95.90 | 3.00–5.00 | 0.4–0.7 | 0.7–1.0 | — |
| MIM-4600 | 94.9–98.5 | 1.5–2.5 | 0.0–0.1 | 0.0–0.5 | — |
| MIM-4650 | 94.4–98.1 | 1.5–2.5 | 0.4–0.6 | 0.0–0.5 | — |
| MIM-2700 | 88.9–93.5 | 6.5–8.5 | 0.0–0.1 | 0.0–0.5 | — |

The iron-base metal powders are initially mixed with gel-forming material and a solvent at a temperature sufficient to insure dissolution of the gel-forming material in the solvent. This molding composition is proportioned to be fluid enough to enable it to be readily supplied to a die or mold by any of a variety of techniques, and especially by injection molding or extrusion. The mixing may be done as a separate step prior to injection molding or extrusion or it may be integrated with the molding or extrusion step.

Generally, the amount of metal powder in the mixture is about 50 percent to about 96 percent by weight of the mixture. Preferably, the metal powder constitutes about 80 percent to about 95 percent by weight of the mixture, and most preferably constitutes about 88 percent to about 94 percent by weight of the mixture.

The gel-forming material employed in the binder is a material that exhibits a gel strength of at least about 200 g/cm$^2$, measured at a temperature of 23° C. on a gel comprising 1.5 wt % of the gel-forming material in 98.5 wt % solvent. This is the minimum value of gel strength necessary to produce a self-supporting article having sufficient green strength to be handled at ambient temperature without the need for special handling equipment. Preferably gel strength is greater than about 1000 g/cm$^2$. Higher values of gel strength can be particularly useful in producing parts with complex shapes, thinner cross-sections, and/or higher weights. Furthermore, higher gel strengths may enable the use of smaller amounts of the gel-forming material in the molding composition.

The gel strength of the gel-forming material is measured by using an apparatus commonly employed in the manufacturing of industrial gums. The standard apparatus consists of a rod having a 1 cm$^2$ circular cross section, one end thereof which is suspended above one pan of a twin pan balance. A large container is placed on the other pan of the balance. A smaller container on the pan, above which is suspended the rod, is filled with about 200 ml (volume) of a gel having about 1.5 wt. % of the gel-forming material dissolved in a solvent. The empty container is then balanced against the gel-containing container. The rod is then lowered into contact with the top surface of the gel. Water is then metered into the empty container and the position of the balance pointer is continuously monitored. When the top surface of the gel is punctured by the rod, the balance pointer rapidly deflects across the scale and the water feed is immediately discontinued. The mass of water in the container is then measured and the gel strength, weight (force) per unit area, is calculated.

Figure 3:
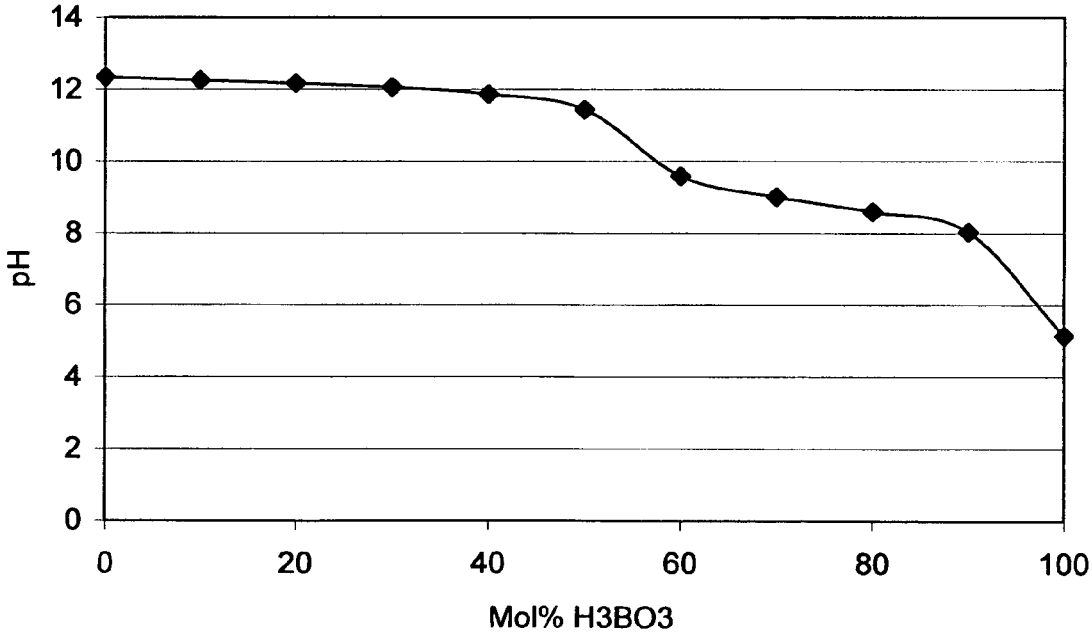
FIG. 3 shows the effect of $H_3BO_3$ mole fraction on pH on solutions of KOH—$H_3BO_3$.
Figure 4:
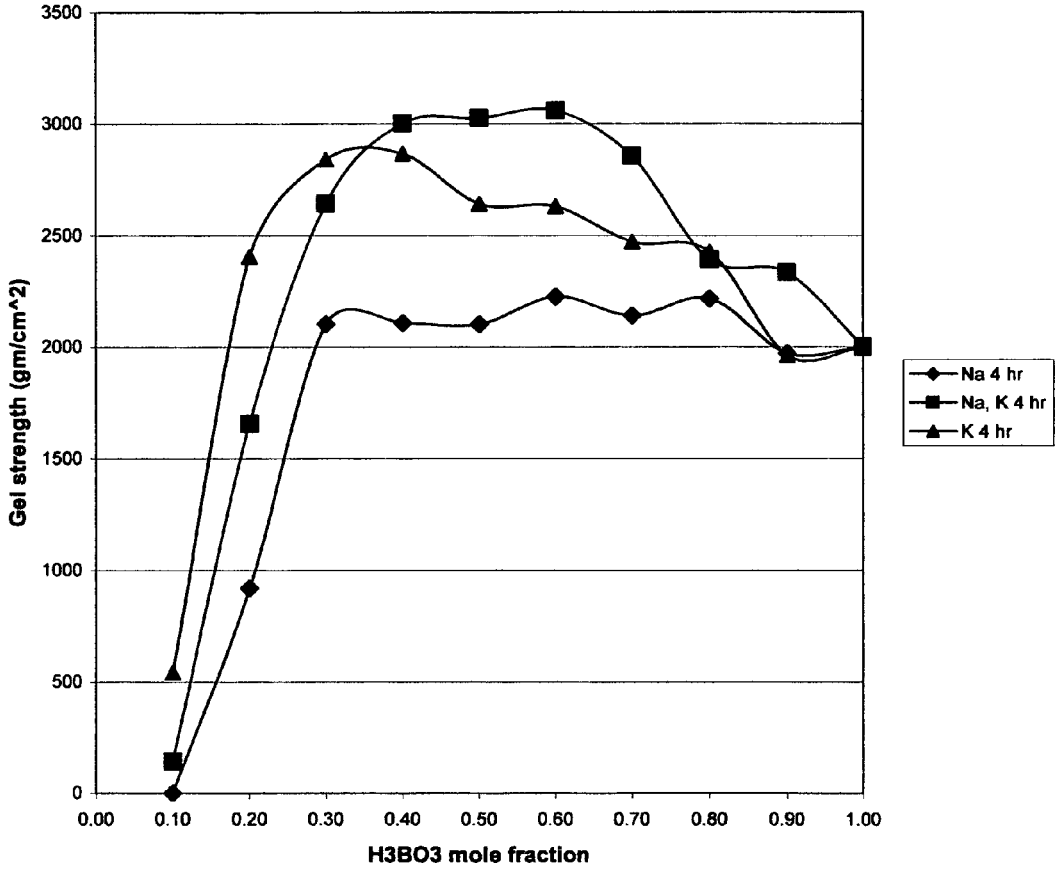
FIG. 4 shows the effect of $H_3BO_3$ molar fraction on the gel strength of three 2 wt. % agar gels made using 0.04 molar $H_3BO_3$ solutions also containing KOH, NaOH, and ($K_{0.5}$, $Na_{0.5}$)OH, respectively

The gel strength measurements reported herein in FIGS. 3 and 4 were obtained by this general method with the exceptions that the agar concentration was 2% and the indenting rod had a smaller cross-sectional area of 0.318 $cm^2$ (corresponding to a diameter of 0.25 inches).

Gel forming materials include polysaccharides including agaroids, proteins, starches, methyl cellulose and synthetic polymers such as polyvinyl alcohol, polyacrylamide, and polyvinyl pyrrolidone. Preferred gel forming materials are polysaccharides including agariods, and other natural gums, and synthetic water soluble polymers. An agaroid is defined as a gum resembling agar but not meeting all of the characteristics thereof. (See H. H. Selby et al., "Agar," Industrial Gums, Academic Press, New York, N.Y., 2nd ea., 1973, Chapter 3, p. 29). As used herein, however, agaroid not only refers to any gum, resembling agar, but also to agar and derivatives thereof such as agarose. An agaroid is particularly useful because it exhibits rapid gelation within a narrow temperature range, a factor that increases the rate of production of molded articles. The gel point of the gel-forming material is preferably about 10° C. to about 60° C. and most preferably is about 30° C. to about 45° C.

The preferred gel-forming materials are those which are readily water soluble and comprise an agaroid, or more preferably, agar, and the most preferred gel-forming materials consist of agar or agarose.

The gel-forming material is provided in an amount from about 0.2 wt % to about 5 percent by weight of the molding composition. Most preferably, the gel-forming material comprises between about 1 percent and about 3 percent by weight of the molding composition.

The solvent for the gel-forming material is preferably water based and may also contain one or more of a number of polar liquids, including low molecular weight alcohols, polyhydric solvents such as ethylene glycol and glycerine. It is most preferable to employ a solvent that can also provide fluidity to the molding composition at elevated temperature, thus enabling the molding composition to be easily supplied to a mold. Aqueous solvent systems are particularly suited for serving as both solvents for the gel-former and providing the desired rheological properties to the molding composition. Water is also easily removed from the molded body prior to and/or during firing.

Preferred are aqueous solvents containing at least about 50 wt. % water. More preferred are solvents containing 75 wt. % water. Most preferred are aqueous solvents containing at least about 90 wt. % water. Water is the preferred solvent for agaroid and many other gel-forming materials.

Generally, the solvent is about 3 percent to about 50 percent by weight of the molding composition depending upon the viscosity desired. Where the gel-former is a polysacharide and the solvent is water, the water is between preferably about 4 percent to about 20 percent by weight of the mixture, with about 5 percent to about 12 percent by weight being more preferred.

However, many iron and iron-base alloy powders react with water in the preferred aqueous binders to form rust. It has been found that the iron and iron-containing powders can be rendered stable against rusting, without adverse effects on gel strength or processibility, by incorporation of small amounts of soluble alkali metal borates in the aqueous binder. Preferred inorganic borates are those of sodium and potassium.

FIG. 1 shows a map of the preferred range of equivalent molar concentrations of $H_3BO_3$ and NaOH, 10, with lines representing solutions of $Na_2B_4O_7$ and $NaBO_2$. The map for potassium borates or mixed Na,K borates would be essentially the same. The molar ratio of $H_3BO_3$ to (Na,K)OH for the preferred sodium and/or potassium borate salts is preferably in the range of 0.5 to 2 and more preferably in the range of from 1 to 1.8. The borate salt concentration, expressed in terms of the equivalent molar concentration of $H_3BO_3$ in the aqueous solvent is preferably in the range 0.035 to 0.3 moles $H_3BO_3$/liter. The equivalent concentration of $H_3BO_3$ is defined as the product of the molar concentration of the borate salt and the mole fraction of $H_3BO_3$ comprising the borate salt.

Preferable starting materials for preparation of the borate solutions include boric acid, sodium tetraborate decahydrate, potassium tetraborate tetrahydrate, and standardized solutions of sodium and/or potassium hydroxide. Solid sodium and potassium hydroxides and metaborate salts are less preferable since they generally contain indeterminate amounts of water, making precise and reproducible formulation of the solutions difficult.

Figure 2:
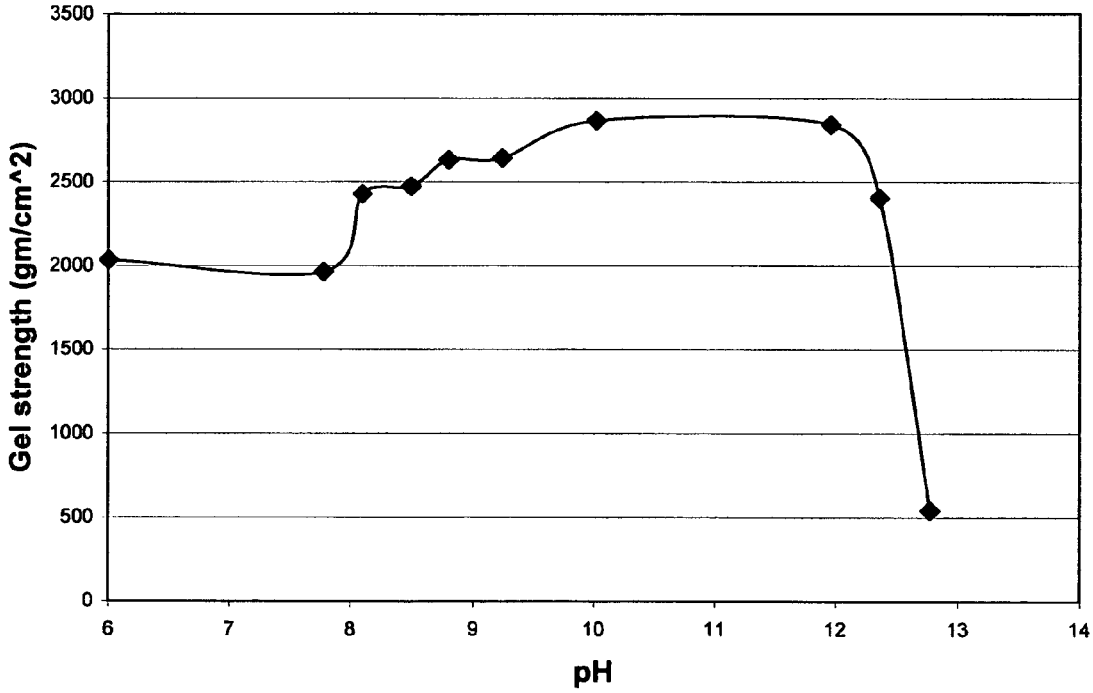
FIG. 2 shows the effect of pH on the gel strength of 2 wt. % agar gels in KOH—$H_3BO_3$ solutions containing 0.04 moles of $H_3BO_3$/liter.

The pH of the solution is preferably held in the range of from 9 to 12 and more preferably in the range of from 9.5–10.5 by adjustment of the (Na, K) OH concentrations. Maintaining the pH in this range imparts stability against rusting while maximizing gel strength. Higher pH would be more beneficial in inhibiting rusting, but reduces gel strength of the preferred agaroid gel forming compounds as illustrated in FIG. 2, which shows the effect of solvent pH on the gel strength of 2 wt. % agar gels in KOH—$H_3BO_3$ aqueous solutions containing 0.04 moles of $H_3BO_3$/liter.

Solvent pH can be adjusted by changing the molar ratio of boric acid to base in the borate salt. For example, a 0.5 wt. % solution of potassium tetraborate ($K_2B_4O_7$) in distilled water has a pH of about 9.2, while a 0.5 wt. % solution of the potassium metaborate ($KBO_2$) stoichiometry has a pH of about 10.8. FIG. 3 shows the effect of $H_3BO_3$ molar fraction on pH in KOH—$H_3BO_3$ solutions. It can be seen that the pH rises in two steps as the $H_3BO_3$ molar ratio decreases. These steps correspond to stepwise ionization of the weak acid $H_3BO_3$ in the presence of the strong base KOH.

Sodium and potassium ions are chemically similar, and this similarity extends to the effects of their respective borate salts on agar and agaroid gel strength and on the stabilization of rusting iron alloy powders. FIG. 4 shows the effect of $H_3BO_3$ molar fraction on the gel strength of 2 wt. % agar gels made using 0.04 molar $H_3BO_3$ solutions also containing KOH, NaOH, and ($K_{0.5}$, $Na_{0.5}$)OH, respectively.

Pelletized aqueous agar-binder injection molding feedstocks, containing borate binder additives do not exhibit any tacky or sticky properties, as have been noted with the sodium silicate stabilized feedstocks disclosed by Behi, and are easily fed by gravity through the hopper of an injection molding machine or extruder.

Agar and other polysaccharides can be utilized as nutrients by certain bacteria, molds and fungi. Bacterial and other biological attack of the molding compound during storage could result in loss of corrosion protection, and degradation of the binder strength. Thus, it is important that the molding compound be kept free of contamination, especially if there is to be a significant storage period between compounding and molding. This can be accomplished either by storage under sterile conditions, since compounding at temperatures approaching 100 degrees C. is expected to produce a sterile as-compounded product, or by the addition of suitable broad spectrum biocides to the formulation, the latter approach being preferred if the molding composition will be stored for more than about 1 week. Preferred biocide additives include benzoate salts such as n-propyl p-hydroxybenzoate (CAS No. (94-13-3), and methyl p-hydroxy benzoate, also known as Methyl Parabem (CAS No. 99-76-3). These particular biocides are highly effective at concentrations of 0.05–0.5 wt %, based on the water content of the molding compound, and are preferably used in combination to increase the range of bacterial species addressed. Other biocides can also be used provided that they are effective and do not materially degrade the properties or performance of the molding compound.

The molding composition may also contain a variety of other additives, which can serve a number of useful purposes. For example, coupling agents and/or dispersants may be employed to ensure a more homogeneous mixture. Lubricants such as glycerin and other monohydric and polyhydric alcohols may be added to assist in feeding the mixture along the bore of an extruder barrel and/or reduce the vapor pressure of the liquid carrier and enhance the production of the near net shape objects. Small molecule sugars, such as glucose, sucrose, fructose etc., can be used to increase the fluidity of agar-based molding compositions, as described by Behi in U.S. Pat. No. 6,262,150. These fluidizing agents can be used to increase the volume fraction of metal powder in agaroid-based molding compositions leading to reduced shrinkage in the sintering step.

In another embodiment, the invention is a process comprising the steps of: injecting into a mold an aforedescribed molding composition at a temperature above the gel point of the gel-forming material in the molding composition; cooling the molding composition in the mold to a temperature below the gel point of the gel-forming material to produce a self supporting molded article; removing the article from the mold; substantially removing solvent from the molded article; and sintering the molded article in a protective atmosphere and under such conditions of time and temperature as are required to produce a final density greater than about 90% of the theoretical density.

In another embodiment, the invention is a process comprising the steps of: feeding an aforedescribed molding composition into an extruder; extruding the molding composition at a temperature above the gel point of the gel forming material in the molding composition through a shape forming die to form an extrudate; cooling at least the surface of the extrudate to a temperature below the gel point of the gel-forming material to produce a shaped article with at least a self supporting skin; substantially removing the solvent from said shaped article; and sintering said shaped article in a protective atmosphere and under such conditions of time and temperature as are required to produce a final density greater than about 90% of the theoretical density.

During injection molding or extrusion, processing temperatures are preferably as high as can be safely achieved without exceeding the boiling point of the solvent. For agar and agaroid gel formers in water solution, processing temperatures are preferably in the range of from 80C to 90C, and more preferably in the range of from 83 C to 88C.

A wide range of molding or extrusion pressures may be employed. Generally, in an injection molding process, the molding composition is delivered to the mold at pressures from about 20 psi (137 kPa) to about 15,000 psi (100 MPa), although higher or lower pressures may be employed depending upon the molding technique used. Most preferably, the molding pressure is in the range of about 100 psi (690 kPa) to about 12,000 psi (8 MPa). In an extrusion process, the molding composition is delivered to the shape forming die at pressures in the low end of this range.

The temperature of the molded or extruded shape, upon removal from the mold or exit from the extrusion die, is preferably at or below the gel point of the gel-forming material at least at its surface. The gel point of the gel-forming material in the present invention is preferably from about 10° C. to about 60° C., and most preferably is from about 30° C. to about 40° C. The mold or die temperature is maintained at less than about 30° C., and is preferably less than about 25° C. The appropriate temperature of the molding composition can be achieved during or after the mixture is a supplied to the mold or die, and especially by cooling in the mold or die.

After the part has been formed and cooled, the green body thus formed, is a self-supporting body. It may be dried to substantially remove the solvent before being placed into a sintering furnace or it may be dried in the furnace.

In the furnace, the body is sintered in a reducing atmosphere to produce the final dense product. Before being brought to sintering temperature, the green body may first be heated in air or vacuum to moderate temperatures of about 250° C. to about 600° C. to assist in removal of the small amount of organic matter in the body. The sintering times and temperatures (sintering schedules) are regulated according to the powdered material employed to form the part. Sintering schedules are well known in the art for a multitude of iron-base materials. For example, Zhang and German discuss the sintering of MIM Fe—Ni alloys in *The International Journal of Powder Metallurgy,* 38, pp. 51–61 (2002). The fired products produced by the present invention can be very dense, net or near net shape products.

In yet another embodiment, the invention comprises shaped articles comprising a metal powder selected from the group consisting of elemental iron, an iron-base alloy containing less than 10 wt. % chromium, and an iron-based intermetallic compound produced by one of the aforedescribed processes.

As noted previously, an advantage of the processes of the present invention over prior art processes for molding of rust-prone iron based alloys is the use of gel forming binders rather than wax and polymer binders such as described in U.S. Pat. No. 5,250,254. The benefits of this binder system include the ability to mold larger and thicker parts and the ability to achieve higher production rates. Usually, the processing temperatures of the molding composition in the present invention are less than 100° C., and typically about 85° C. These temperatures are substantially lower than the temperatures normally required with the wax and polymer binders. Consequently, the gel-forming materials of the present invention require substantially less mold or die cooling. The advantages of the present invention over earlier methods of chemical stabilization of iron-based powders in aqueous binders, taught in U.S. Pat. Nos. 6,261,336 and 6,689,184, include minimization of residual non-metallic inclusions in the sintered body and minimization of secondary effects such as oxidation.

EXAMPLES

Example 1

This example illustrates the long term corrosion inhibiting effect of an agar gel containing $KBO_2$ in contact with an iron nail. A 10 cc sample of 2 wt. % agar solution was prepared using a 0.1 molar aqueous solution of $KBO_2$ as the solvent. The equivalent molar concentration of $H_3BO_3$ was 0.1 moles/liter and the $H_3BO_3$:KOH ratio was 1:1. After heating to 100 degrees C. to dissolve the agar, the solution was poured into a 20 cc screw top bottle, half filling it, and a soft iron nail was also placed in the bottle. After cooling, approximately half the length of the nail was embedded in the agar gel and the upper half of the nail was in the air space above the agar gel. After one week some rust could be seen on the part of the nail above the agar gel but no rust was visible on the part embedded in the agar gel. After sixteen months, the gel showed no evidence of discoloration and the embedded portion of the nail was still rust free, but the part of the nail exposed to air was encrusted with deposits of reddish-brown rust. This example provides a macro-scale demonstration of effective passivation of iron in contact with agar gel by potassium metaborate.

Comparative Example 1

This example shows the lack of chemical stability of a molding compound comprising carbonyl iron powder and an agar gel binder containing sodium tetraborate decahydrate. A trial molding compound was made by combining 3560 grams of BASF OM grade carbonyl iron powder, 380 grams of distilled water, 80 grams of TIC PRETESTED® Agar Agar 100 and, 1.8 grams of sodium tetraborate decahydrate (Sigma-Aldrich, CAS No. 1303-96-4). This solution had an equivalent molar concentration of $H_3BO_3$ of about 0.052 moles $H_3BO_3$/liter. The $H_3BO_3$ to NaOH ratio was 2:1. The pH of the borate solution was about 9.06. (A similar sodium tetraborate solution mixed with 5 wt. % agar to determine the effect of agar on pH. The pH decreased to about 8.95.) The ingredients were blended in a sigma blade mixer heated to 190° F. for about 30 minutes until the mixture was a homogeneous viscous mass. The material was then cooled to 120° F. in the mixer after which it was removed and shredded in a Kitchen Aid food processor. The moisture level, measured just after shredding, was 8.37%. It was noted that the material began to heat up after shredding and emitted a peculiar odor characteristic of oxidizing carbonyl iron powder. It was concluded that the material was not stable with respect to the reaction of iron with water and oxygen, and no further tests were done on this batch.

Example 2

This example shows that agar-binder molding feedstocks containing carbonyl iron powder can be stabilized against oxidation for several days using high pH sodium borate solutions as solvents for the agar. Four small batches of feedstock were prepared, each containing 50 grams of BASF OM grade carbonyl iron powder, 2 grams of TIC PRETESTED® Agar Agar 100, and 20 cc of a 1.0 weight % solution of $NaBO_2$-$xH_2O$ (Sigma-Aldrich, CAS No. 15293-77-3) to which small amounts of NaOH were added to increase the pH. The pH values of the borate solutions in samples 1 through 4, respectively, were 11.4, 11.84, 12.04, and 12.14. The $H_3BO_3$ to NaOH ratios of these samples were between 1:1 and 0.5:1 and, the equivalent molar concentration of $H_3BO_3$ was about 0.11. The samples were prepared by thoroughly mixing the ingredients in small jars and then heating to about 100° C. in a double boiler for about 30 minutes followed by cooling and chopping into 2–4 mm granules. After cooling and chopping, the characteristic odor of corroding carbonyl iron powder was present but much less than in the lower pH samples in Comparative Example 1. The as-cooled samples were very elastic in consistency.

After three days the color, odor and elasticity of all of the samples was unchanged, showing significantly greater stability than the samples in Comparative Example 1. After seven days, however, all four samples had lost their elasticity and showed localized areas of darker color, indication progress of the oxidation reaction.

The three day shelf life demonstrated in this example would be useful for molding compounds which are blended and molded in the same facility, but is not sufficient for commercial centralized production, storage, and sale of molding feedstock to multiple users.

Examples 3–6

This example shows the borate concentration ranges required for long term passivation of water atomized Fe 2% Ni powder in solutions of sodium and potassium borates. Twenty-eight one ounce jar samples were prepared, each containing 20 cc of borate solution and about 4 gm of Atmix grade PF 10 F water-atomized iron 2% nickel powder. Four borate salts were screened with seven samples each at concentrations of 0.02, 0.05, 0.1, 0.2, 0.5, 1.0, and 2.0 wt. %. The four borate salts were potassium tetraborate tetrahydrate (Sigma-Aldrich, CAS No. 12045-78-2), potassium metaborate hydrate (Alpha-Aesar, CAS No. 16481-66-6), sodium tetraborate decahydrate (Sigma-Aldrich, CAS No. 1303-96-4), and sodium metaborate hydrate (Aldrich CAS No. 15293-77-3). The potassium metaborate hydrate had an assay of approximately 32 wt. % $B_2O_3$ and 43 wt. % $K_2O$, corresponding to about 75 wt. % $KBO_2$ anhydrous and 25 wt. % water, which is equivalent to a formula weight of about 109.38. This is approximately equivalent to $KBO_2.1.5H_2O$. The sodium metaborate hydrate was analyzed for water content by drying a 10 gm sample at 150° C. for two hours and measuring weight loss, yielding an assay of about 75 wt. % $NaBO_2$ anhydrous, which corresponds to an effective formula weight of 87.7 or the approximate formula $NaBO_2.1.2H_2O$.

All of the samples were mixed cold and then heated together in an oven set at 90° C. for about 2 hours to simulate the thermal activation effects of compounding. After 24 hours red rust could be seen beginning to form in some of the jars. After 8 days, the iron powder in these jars was covered with red rust and the remaining jars were rust free. After 20 days some additional rusting was observed. The results after 9 months are shown in table 1. The data shows that the lower $H_3BO_3$ mole fraction, higher pH sodium and potassium meta-borate solutions are more potent rust inhibitors.

For the rust free sample in Example 3, the $H_3BO_3$ to KOH ratio was 2:1 and the equivalent molar concentration of $H_3BO_3$ was about 0.26 moles/liter. For the rust free samples in Example 4 the $H_3BO_3$ to KOH ratio was 1:1 and the equivalent molar concentration of $H_3BO_3$ was between about 0.046 and 0.185 moles/liter. For the rust free sample in Example 5 the $H_3BO_3$ to NaOH ratio was 2:1 and the equivalent molar concentration of $H_3BO_3$ was 0.21 moles/liter. For the rust free samples in Example 6 the $H_3BO_3$ to NaOH ratio was 1:1 and the equivalent molar concentration of $H_3BO_3$ was between about 0.057 and 0.22 moles/liter.

TABLE I

| Example | Borate salt | 2 wt. % | 1% | 0.5% | 0.2% | 0.1% | 0.05% | 0.02% |
|---|---|---|---|---|---|---|---|---|
| 3 | $K_2B_4O_7.4H_2O$ | clean | rust | rust | rust | rust | rust | rust |
| 4 | $KBO_2.1.5\ H_2O$ | clean | clean | clean | rust | rust | rust | rust |
| 5 | $Na_2B_4O_7.10H_2O$ | clean | rust | rust | rust | rust | rust | rust |
| 6 | $NaBO_2.1.2H_2O$ | clean | clean | clean | rust | rust | rust | rust |

Example 7

Figure 5:
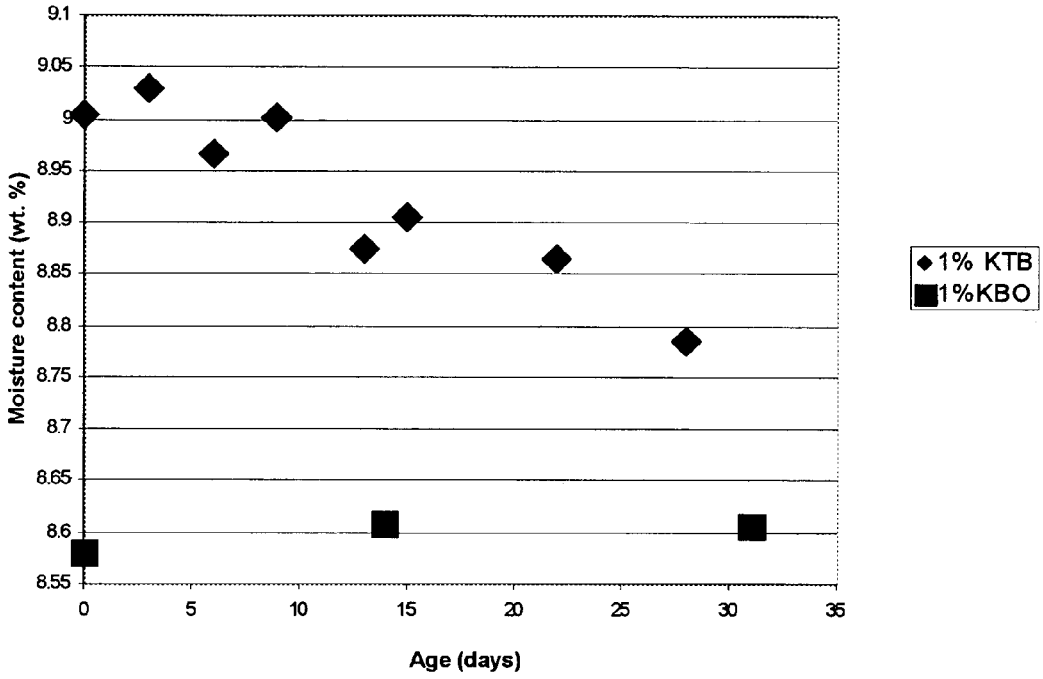
FIG. 5 shows the effect of time on the moisture content of Fe2% Ni molding compounds stabilized with KTB ($K_2B_4O_7.4H_2O$) and KBO ($KBO_2.xH_2O$).

This example shows intermediate term chemical stability of molding compounds comprising water atomized Fe2% Ni powders and agar gel binders containing potassium tetraborate tetrahydrate. A trial molding compound was made by combining 3560 grams of Atmix grade PF 10 F water-atomized iron 2% nickel powder, 380 grams of distilled water, 80 grams of TIC PRETESTED® Agar Agar 100 and, 3.6 grams of potassium tetraborate tetrahydrate (Sigma-Aldrich, CAS No. 12045-78-2) in a sigma blade mixer heated to 190° F. for about 30 minutes until the mixture was a homogeneous viscous mass. The material was then cooled to 120° F. in the mixer after which it was removed and shredded in a Kitchen Aid food processor. The moisture level immediately after shredding was 9.004%. The $H_3BO_3$ to KOH ratio was 2:1 and the equivalent molar concentration of $H_3BO_3$ was about 0.13 molesaiter. A portion of the material was delivered to the hopper of a Boy 22 M injection molding machine to test feeding and flow properties. The material fed easily into the screw and was injected into a standard spiral flow mold. The spiral flow distance at a hydraulic pressure of 250 psi (average of 6 readings) was 1.27 inches, and at a hydraulic pressure of 500 psi, the average spiral flow distance was 4.83 inches. These values are within the acceptable range for metal injection molding of agar binder feedstocks. After three days the moisture level was re-measured at 9.03 weight %, and after six days the material was visually unchanged and moisture level was 8.966 wt. %. FIG. 5 shows a gradual decline in moisture level over a period of 30 days which is attributable to reaction of water with the iron powder. This material could be compounded and molded within a few days but would not be suitable for storage.

Example 8

This example shows intermediate term chemical stability of molding compounds comprising water atomized Fe2% Ni powders and agar gel binders containing potassium metaborate. A trial molding compound was made by combining 3560 grams of Atmix grade PF 10 F water-atomized iron 2% nickel powder, 380 grams of distilled water, 80 grams of TIC PRETESTED® Agar Agar 100 and, 3.6 grams of potassium metaborate hydrate (Alpha-Aesar, CAS No. 16481-66-6) in a sigma blade mixer heated to 190° F. for about 30 minutes until the mixture was a homogeneous viscous mass. The material was then cooled to 120° F. in the mixer after which it was removed and shredded in a Kitchen Aid food processor. The moisture level immediately after shredding was 8.58 wt. %. The $H_3BO_3$ to KOH ratio was 1:1 and the equivalent molar concentration of $H_3BO_3$ was between about 0.09 moles/liter. The moisture stability over 30 days is shown in FIG. 5. After 66 days the moisture level was re-measured at 8.571 weight %, and the material was visually unchanged. Thus, the potassium metaborate stabilized material has undergone no detectable reaction in more than 2 months, indicating a probable shelf life of 4 months or longer. A portion of the aged material was delivered to the hopper of a Boy 22 M injection molding machine to test feeding and flow properties. The material fed easily into the screw and was injected into a standard spiral flow mold. The spiral flow distance at a hydraulic pressure of 250 psi (average of 7 readings) was 0.36 inches, and at a hydraulic pressure of 500 psi, the average spiral flow distance was 3.0 inches. These values are within the acceptable range for metal injection molding of agar binder feedstocks.

Having thus described the invention in rather full detail, it will be understood that such detail need not be strictly adhered to but that further changes and modifications my suggest themselves to one skilled in the art, all falling within the scope of the invention as defined by the subjoined claims.

What is claimed is:

1. A corrosion resistant molding composition consisting essentially of:

a) least one metal powder selected from the group consisting of the rusting alloys of iron;

b) a gel forming polysaccharide binder; and c) a solution comprising;

(i) at least one borate selected from the group consisting of boric acid ($H_3BO_3$), and a borate salt of sodium or potassium, said borate being present at an equivalent $H_3BO_3$ molar concentration in the range of from 0.035 to 0.3 moles/liter.

(ii) at least one alkali metal hydroxide selected from the group consisting of sodium hydroxide (NaOH), and potassium hydroxide (KOH), wherein the equivalent $H_3BO_3$ to alkali metal hydroxide molar ratio in the solution is in the range of from 0.5 to 2.0;

(iii) a solvent for said gel forming binder, said borate salt and said alkali metal hydroxide, wherein the solvent concentration in said molding composition is from 5 to 20 wt. %.

2. The molding composition of claim 1, wherein said gel forming material is an agaroid.

3. The molding composition of claim 1, wherein said gel forming material is an agar, agarose or a mixture thereof.

4. The molding composition of claim 1, wherein said solvent for said gel forming material comprises water.

5. The molding composition of claim 1, wherein the metal powder component comprises carbonyl iron and the solvent comprises a sodium or potassium borate solution with a pH value, measured prior to mixing with metal powder and agar, in the range of from 10 to 12.2.

6. The molding composition of claim 1, wherein the metal powder comprises a gas or water atomized iron-based alloy and the solvent comprises a sodium or potassium borate solution with a pH value, measured prior to mixing with metal powder and agar, in the range of from 9.5 to 12.2.

7. The molding composition of claim 1, further comprising at least one member selected from the group consisting of coupling agents, biocides, lubricants, fluidizing agents, and dispersants.

8. The molding composition of claim 1 further comprising a ceramic powder, wherein the ceramic powder is less than 50 vol. % of the combined volumes of metal powder plus ceramic powder.

* * * * *